United States Patent [19]

Hartbauer

[11] 4,000,242

[45] Dec. 28, 1976

[54] WEB MATERIAL TREATING SYSTEM INCLUDING AN INFLATABLE PLATEN ROLLER

[75] Inventor: Ellsworth A. Hartbauer, Concord, Calif.

[73] Assignee: Crown Zellerbach Corporation, San Francisco, Calif.

[22] Filed: Oct. 3, 1975

[21] Appl. No.: 619,262

Related U.S. Application Data

[63] Continuation of Ser. No. 275,222, July 26, 1972, abandoned.

[52] U.S. Cl. ..... 264/284; 29/113 AD; 100/163 R; 100/170; 100/211; 101/23; 156/220; 162/117; 162/362; 425/368

[51] Int. Cl.[2] ..... B31F 1/00

[58] Field of Search ..... 162/117, 109, 205, 360 R, 162/361, 362; 264/284, 293; 156/209, 219, 220, 582; 29/113 R, 113 AD; 100/160, 163 R, 164, 170, 211; 425/368; 101/6, 23

[56] References Cited

UNITED STATES PATENTS

| | | | |
|---|---|---|---|
| 3,129,457 | 4/1964 | Carter et al. | 264/284 X |
| 3,610,137 | 10/1971 | Brafford | 100/170 X |
| 3,611,919 | 10/1971 | Thomas | 101/23 |
| 3,699,621 | 10/1972 | Clarke et al. | 29/113 R |
| 3,707,749 | 1/1973 | Henley | 29/113 R |
| 3,841,963 | 10/1974 | Schlunke | 162/362 |

*Primary Examiner*—S. Leon Bashore

*Assistant Examiner*—Richard V. Fisher

*Attorney, Agent, or Firm*—Thomas R. Lampe; Corwin R. Horton

[57] ABSTRACT

A system for treating paper webs and the like including a platen roller and a plurality of support rollers angularly spaced thereabout. At least one of the support rollers is an embossing roller cooperative with the platen roller to emboss a web advanced between the facing juxtaposed surfaces of the platen and embossing rollers. The platen roller is floatingly confined by the support rollers and has no rigidly fixed axis of rotation. Such platen roller is also hollow, including a cylindrical wall component defining a gaseous fluid pressurized chamber. The cylindrical wall component of the roller is of resilient construction and is inwardly depressible by the support rollers against the force of the gaseous pressure fluid acting outwardly thereagainst within the pressurized chamber. The web material to be treated is passed through the nips defined by one or more support rollers, including at least one embossment roller, and the platen roller. While passing through and between said nips the web material is continuously supported over substantially the entire surface area along one side thereof without application thereto of tensile stress of a magnitude tending to tear the same. Besides treating the web material to provide an embossed appearance thereto the system otherwise treats it to provide for increased absorbency, softness and apparent bulk.

21 Claims, 9 Drawing Figures

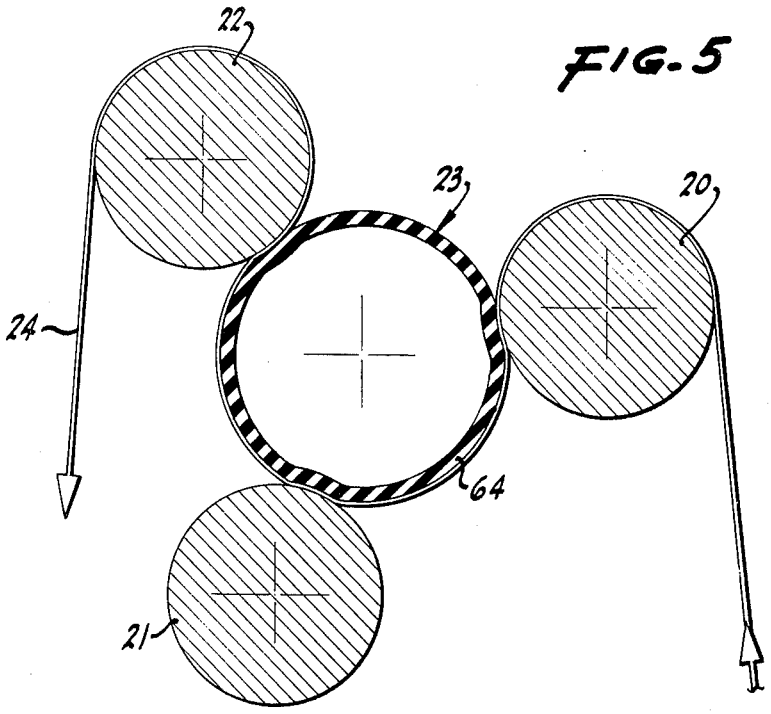
FIG. 5
FIG. 4
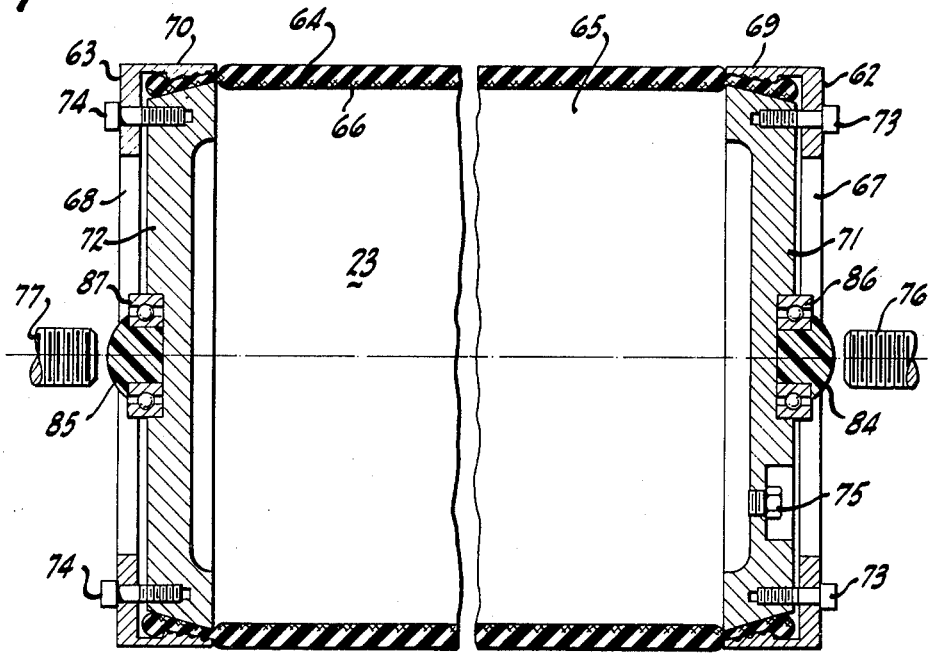

WEB MATERIAL TREATING SYSTEM INCLUDING AN INFLATABLE PLATEN ROLLER

This application is a continuation in part of U.S. application Ser. No. 275,222, filed July 26, 1972, and now abandoned.

This invention relates to the art of working or treating web materials and, more particularly, to improved apparatus for and a method of embossing and providing increased absorbency, softness and apparent bulk to paper webs and the like without materially lowering the tensile strength of the web material.

Web materials and especially nonwoven web materials are often worked after their formation to impart particular characteristics thereto such as softness and apparent bulk, and such workings are generally effected by passing the web between a pair of rollers having facing juxtaposed surfaces that respectively engage the web along opposite sides thereof. An exemplary instance of such working of web materials is embossing paper webs and the like to impart a design configuration thereto which, at the same time, tends to increase the apparent bulk of the web and to soften the same to a certain extent.

The conventional embossing apparatus defines only one nip and includes one rigid steel embossing roller having patterned surface areas engageable with a web along one side thereof to imprint the embossing pattern thereon, and a platen roller engageable with the web along its opposite side in cooperation with the embossing roller to provide a backing surface to support the web as the pattern is embossed thereon. The platen roller conventionally has a rigid steel core and a resilient cover or sleeve of rubber confined thereabout defining the backing surface that cooperates with the embossing roller in application of the compressive force to the web. This resilient sleeve affords the requisite give or yieldability accommodating deformation of the web in the localized areas thereof corresponding to the raised portions of the pattern carried by the embossing roller.

It is also conventional to provide a single embossing nip between two rigid steel patterned embossing rolls, one of which is pressured against stops to operate at a predetermined (adjustable) clearance between the patterns which are intermeshed.

Although embossing apparatus of the foregoing types are in extensive use, they do have a number of disadvantages and limitations included among which are the relatively expensive, complex and heavy bearings required to support the various rollers at the ends thereof, and which define fixed axes of rotation, for appropriately loading or applying the requisite forces thereto so that the embossing pattern is properly applied to the web material, and the strength and mass required for the rollers to adequately resist bowing thereof intermediate the bearing supports at their ends. Because of the massive size and weight of the prior art rollers it will be appreciated that changing rollers becomes an expensive and time-consuming proposition. Further, it is conventional to use engraved embossing rollers and because of their size and weight it is not uncommon for these rollers to cost 30 to 35 thousand dollars or more. Obviously, these factors make changing embossment designs an expensive proposition. Further, in spite of the efforts made in the prior art to prevent bowing and distortion of the rollers it is impossible to prevent this altogether and uneven pressures continue to develop across the nip so the embossing is not entirely uniform.

Further, with respect to the former type of conventional embossing apparatus discussed above, the platen roller because of its solid metal core is heavy and therefore has substantial inertia which, together with the mechanical hysteresis present therein because of the working tending to be imparted thereto by the embossing forces, produces considerable heat which is an undesirable by-product of the embossing operation resulting, among other things, in accelerated deterioration of the resilient cover which is conventionally rubber. It has been found that, in general, the softer the rubber covering the more rapid the deterioration because of heat build-up. For this reason, a relatively hard rubber is usually employed as the platen roller cover. Unfortunately, the use of a relatively hard rubber tends to create a smooth and compacted web material which is often undesirable as in the case of consumer paper products such as facial tissue or toilet tissue where a soft surface "feel" is desirable, as are the characteristics of high apparent bulk and absorbency. The term "apparent bulk" as used herein is defined as the caliper of a wound roll of a given length of embossed sheet material and is a measure of the total roll bulk as contributed by both the sheet thickness and the embossed projections.

Another important disadvantage, is that such conventional embossing apparatus imparts undue longitudinal stretching to the web material processed thereby with attendant strength deterioration which tends to tear or fracture the web material, thus necessarily imposing the requirement that the material have a relatively high tensile strength. In the case of paper tissue products this need for a relatively high tensile strength translates into a need for a higher basis weight than otherwise might be required. The reason that such tensile forces are applied to the web material during the embossing operation is believed to reside in the development of velocity differences as between the coacting surfaces of the embossing and platen rollers caused by the bodily displacement of the resilient sleeve or cover enclosing the rigid metal core of the platen roller. That is to say, whenever any relatively dense (i.e., a non-sponge-like material having a substantial volume of interstitial voids) resilient material is compressed in one direction, it must enlarge in some other direction. In the case of the conventional platen roller, the compressive inward displacement imparted to the resilient cover by the force of the embossing roller pressing thereagainst results in wave-like outer enlargements or protuberances being formed along the surface of the platen roller on both sides of the inward depression. This phenomenon results in drastic speed differentials being formed between the embossing and platen rollers in the vicinity of the wave-like enlargements. Web material in engagement with the platen roller is thus required to traverse a longer path than the surface of the web in engagement with the embossing roller and is subjected to the speed differentials at the protrusions. The consequent tensile stress applied to the web material, which tends to break same, is evident.

Apparently, as a result of this action, it has been practicably necessary in the past to remove the web material from the platen roller as quickly as possible and immediately adjacent the embossing station so as to minimize the tensile stress applied to the web material. The necessary path of travel thereby dictated for the web material increases the complexity of the embossing operation in that it requires the inclusion of a plurality of guide rollers which also subjects the web material to additional, but non-beneficial, stresses.

In view of the foregoing, a general object of the present invention is to provide improved apparatus and a method of working web materials as, for example, to emboss the same; and which apparatus and method obviate many of the disadvantages and limitations characterizing prior systems including the disadvantages heretofore explained. As respects such improved method and apparatus, it is applicable to a great variety of web materials including any material that is generally enhanced by embossing or other working thereof effected by cooperative rollers including nonwoven materials such as conventional paper webs (toilet tissue, toweling, facial tissue, Kraft paper, etc.) and plastic films (polyethylene, for example), synthetic pulp materials such as those comprised either entirely or partially of synthetic plastic fibers, laminates, impregnated webs, etc.

Another object of the present invention resides in the provision of an improved apparatus and method of the character described that produces an improved web product and is able to emboss or otherwise work web materials without appreciably stretching or elongating the same longitudinally to such an extent that the web is subjected to undesirable stresses which seriously weaken the web at the embossing or working nip due to speed differentials occurring due to deformation of the platen roller, thereby enabling very much weaker or less strong webs and webs having a lower basis weight (perforated toilet tissue, for example) to be accommodated than those which can be processed by conventional techniques.

Other objects reside in the provision of an embossing apparatus of much simpler and less expensive construction than conventional embossing apparatus, having a generally uniform loading all along the platen roller which due to its accommodation to roller bowing, reduces support-bearing requirements therefor, simplifies the supports for the embossing rollers by obviating the load-adjusting mechanisms otherwise necessary, enables relatively inexpensive fabricating techniques to be used in the manufacture of the embossing rollers; reduces the inertia generally present in platen rollers of conventional design, and obviates much of the heat development in the metal cores of conventional platen rollers resulting from the mechanical hysteresis thereof; enables a relatively hard rubber or other durable elastomeric material to be utilized in the construction of the platen roller without imparting undesirable characteristics to the web; in which the web is selectively worked at one or more of a plurality of spaced stations, thereby improving the web product by obviating harshness and one-sidedness of the embossing pattern and softening same, and also further simplifying the apparatus by enabling the embossing rollers to respectively comprise elemental, mostly linear segments of the composite embossing pattern; in which the platen roller has no fixed axis of rotation, thereby enabling it to seek a neutral axis of rotation that can automatically shift or change as necessary to accommodate asymmetrical loadings thereon (web bunching, for example) which obviates damage that would occur to conventional systems as a consequence thereof; and in which the platen roller has a pressurizable chamber bounded by a relatively stiff but resilient and inwardly depressible cylindrical surface pressure-reinforced by a gaseous fluid confined under pressure within the chamber and in which the platen roller pressure may be varied by the operator.

A still additional object resides in the provision of an improved apparatus and method in which lower basis weight webs may be treated in such a manner as to give them the same apparent bulk as higher basis weight webs treated by conventional embossing arrangements, thus leading to economics and conservation of material. This object is attained by providing improved embossing definition. Prior art rubber to metal embossing nips appear to provide good embossing definition only at the high embossing points while the present arrangement results in a more complete molding of the sheet material about the embossment surfaces, thus providing improved embossing definition and an increase in apparent bulk of the sheet.

Additional objects and advantages of the invention, especially as concerns particular features and characteristics thereof, will become apparent as the specification continues.

Embodiments of the invention are illustrated in the accompanying drawings, in which:

FIG. 4 is a further enlarged, axial sectional view taken through the platen roller of the apparatus;

FIG. 5 is essentially a diagrammatic view depicting the cooperative interengagement of the embossing and platen rollers and the movement of a web advanced through the successive operating stations defined thereby;

Figure 7:
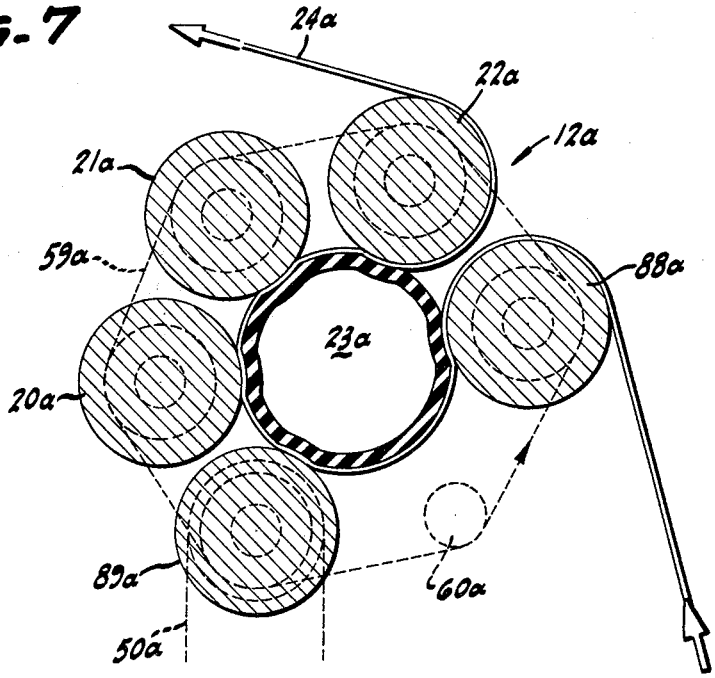
FIG. 7 is essentially a diagrammatic view, generally similar to that of FIG. 5, but illustrating a modified apparatus having an increased number of operating stations.
Figure 8:
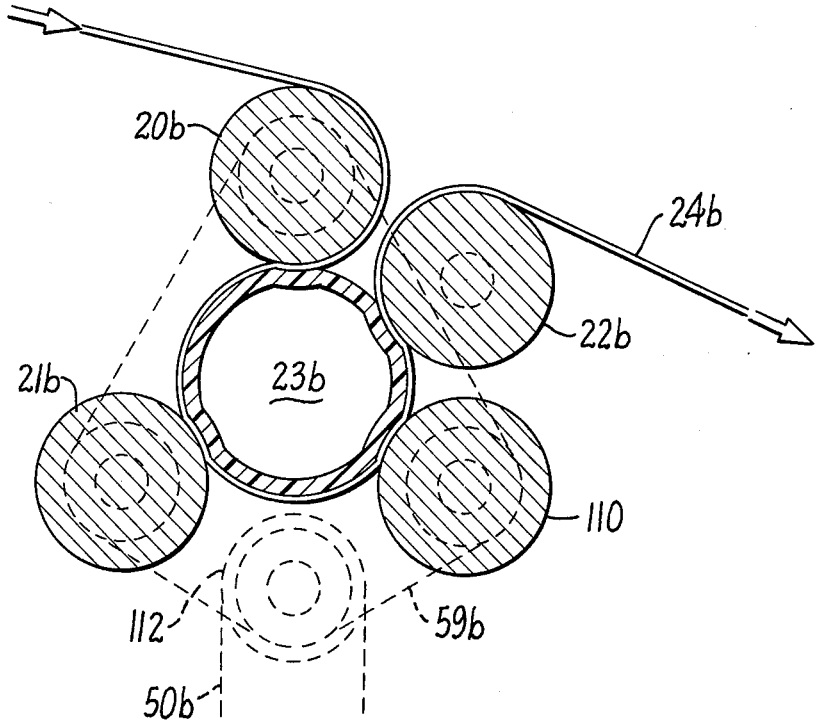
Figure 9:
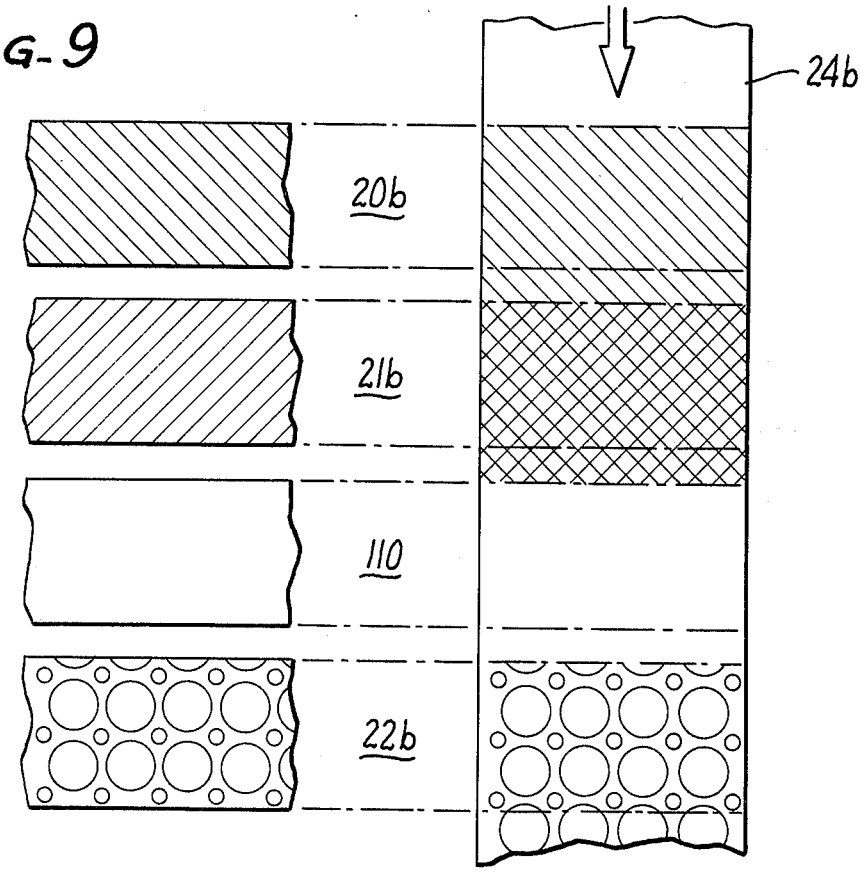

FIG. 8 is essentially a diagrammatic view, generally similar to those of FIGS. 5 and 7, but illustrating still another form of apparatus constructed in accordance with the teachings of the present invention, particularly applicable to embossment of a tissue web; and FIG. 9 is a diagrammatic view illustrating the succession of embossing operations imparted to a web processed by the form of apparatus shown in FIG. 8.

Figure 1:
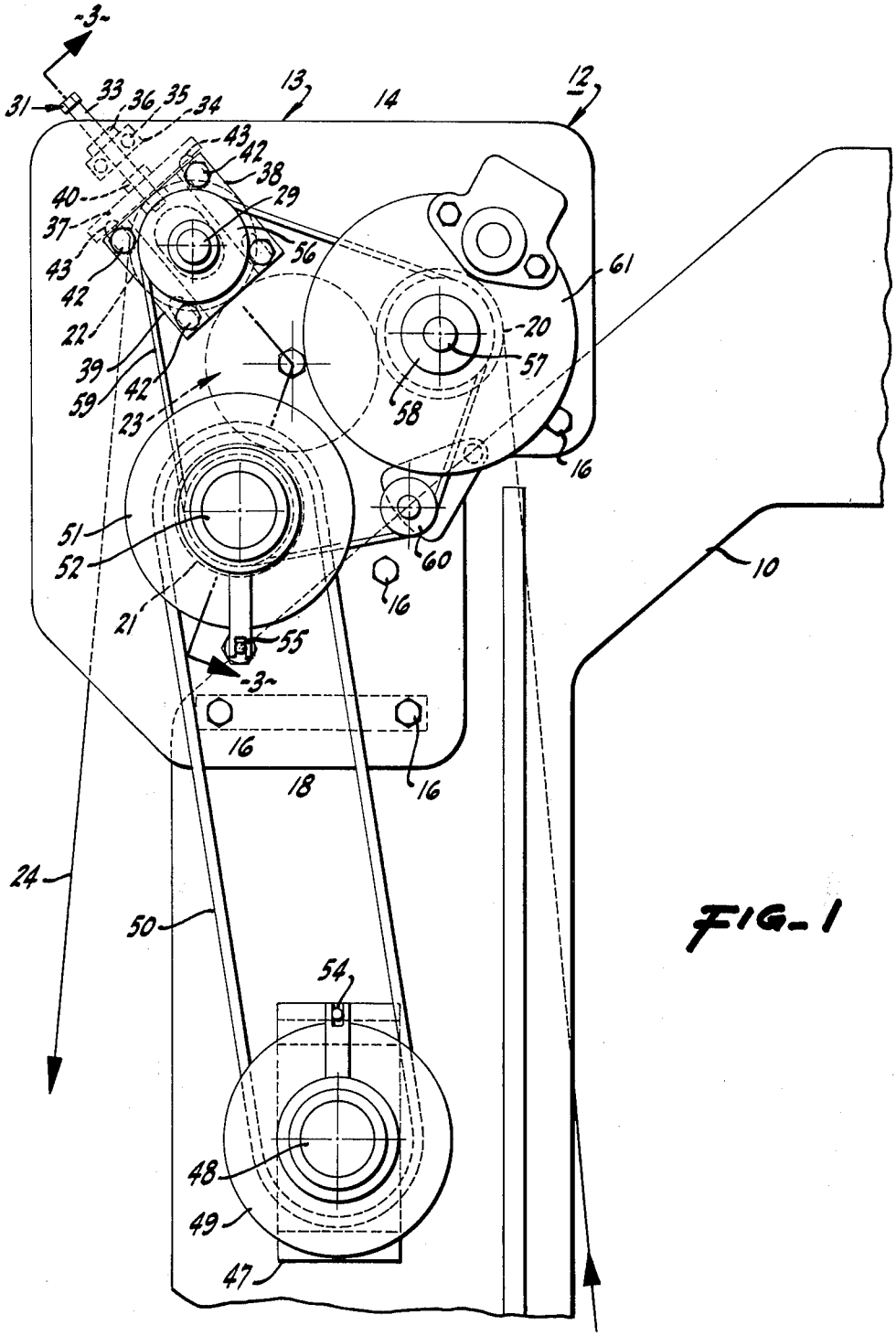
FIG. 1 is a side view in elevation of apparatus embodying the invention shown in operative association with a web rewinding machine for toilet tissue.
Figure 2:
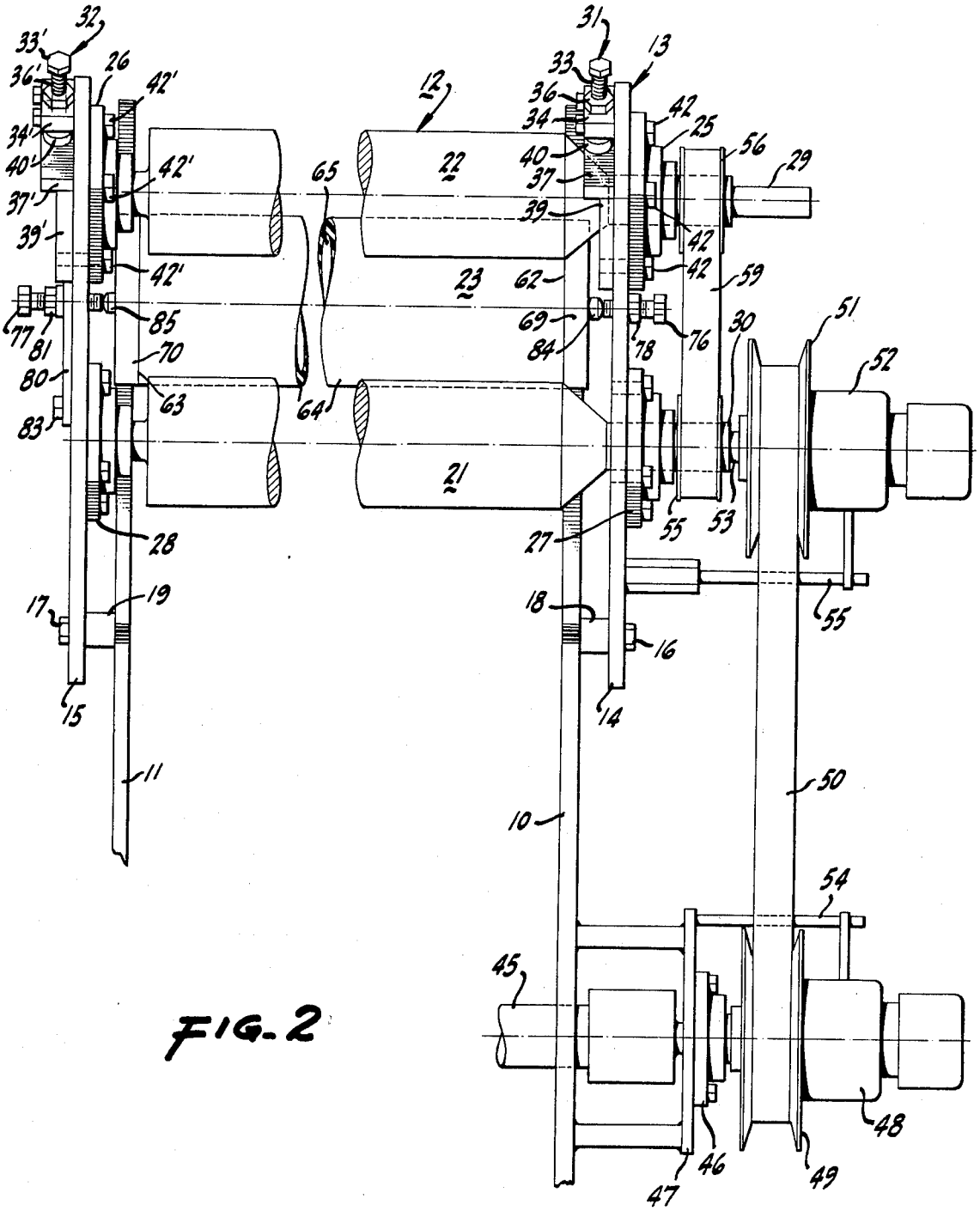
FIG. 2 is a front view in elevation of the apparatus from the infeed side thereof looking generally from left to right as the apparatus is shown in FIG. 1.

Apparatus embodying the present invention may be used either as an independent integer having no particular association with any other web-processing apparatus or, most conveniently, it may be associated with conventional web-processing machinery to contribute to the over-all operation performed thereby. Essentially, the only difference as between such variant uses of the apparatus will reside in the particular manner in which it is supported and, perhaps, the source of power used to drive the various rollers thereof. In the embodiment of the invention illustrated in FIGS. 1 and 2, the apparatus is illustrated in functional association with other web processing machinery and, specifically, a web rewinding machine of the type used to rewind rolls of toilet tissue from a large parent or supply roll. Only a portion of a typical web rewinding machine is shown in FIGS. 1 and 2, namely, the backstand portion or frame components thereof and these components are respectively denoted with the numerals 10 and 11. Apparatus embodying the invention is denoted generally with the numeral 12, and it includes frame structure 13 having axially spaced side plates 14 and 15 associated with and fixedly secured to the frame components 10 and 11 along the outer faces thereof, such as by bolts 16 and 17. Spacers 18 and 19 may be interposed between the respectively associated frame members 10, 14 and 11, 15 so as to provide the requisite dimensional interrelationship of the apparatus 12 with the associated web rewinding machine.

The apparatus 12 further includes a plurality of cooperative rollers supported by the frame structure 13 for rotation with respect thereto. Certain of the rollers have facing juxtaposed surfaces engageable with a web of material to work the same and, in a more particular sense, to emboss the web with a predetermined configuration. Such plurality of rollers includes a group of support rollers in the form of embossing rollers 20, 21 and 22 (see especially FIG. 5), there being three such rollers in the particular form of the invention shown in FIGS. 1 through 7. Another of the cooperative rollers constitutes a platen roller 23 which, as explained in detail hereinafter, is supported by the embossing rollers 20 through 22 and cooperates therewith in working a web 24 continuously advanced through the successive operating stations defined by the coaction of the various embossing rollers with the platen roller.

Figure 3:
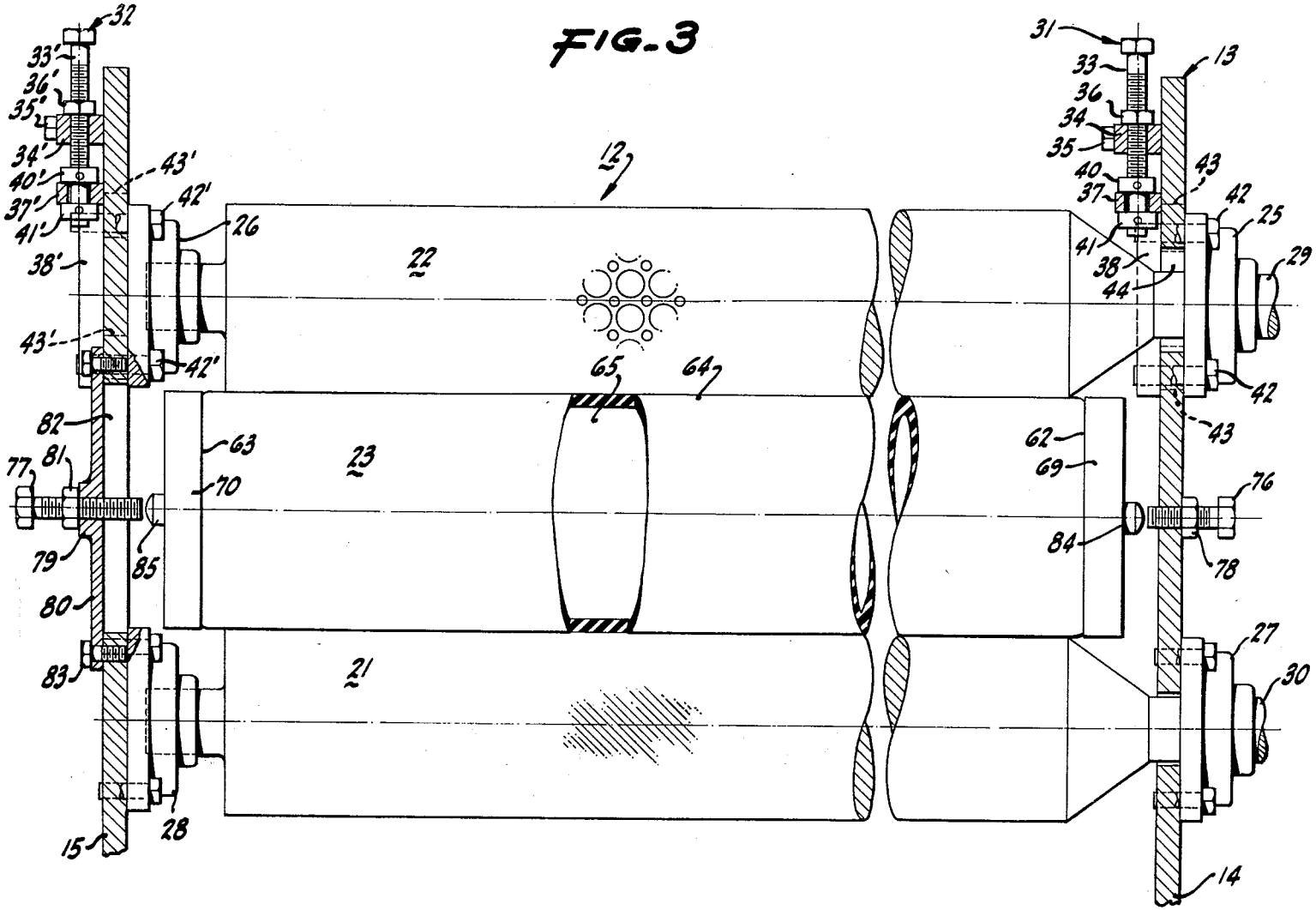
FIG. 3 is an enlarged, vertical sectional view of the apparatus taken along the line 3—3 of FIG. 1.

In this respect, the embossing rollers 20 through 22 are angularly spaced about a common center with their axes of rotation oriented in substantially parallel relation and disposed intermediate the frame plates 14 and 15. The embossing rollers are constrained in such spacial relationship by being journalled for rotation in bearings provided for this purpose which are respectively secured to the plates 14 and 15. The bearing supports for the rollers 22 and 21 are shown in FIG. 3 and are respectively denoted with the numerals 25, 26 and 27, 28. The bearings 25 through 28 are completely conventional, are bolted or otherwise fixedly related to the frame plates 14 and 15 as is evident in FIG. 3, and they respectively support the axles or center shafts 29 and 30 of the rollers 22 and 21. The bearings for the embossing roller 20 are not specifically illustrated in the drawing, but are substantially identical to the bearings for the rollers 22 and 21 and need not be further considered.

Advantageously, the bearing structures associated with at least one of the embossing rollers 20 through 22 enable such roller to be bodily displaced relative to the others to relieve the compressive force applied to the platen roller 23 and enable the same to be removed from the apparatus for repair and replacement. Any such bodily adjustment afforded for such one embossing roller also enables the gripping or compressive force defined between each of the embossing and platen rollers to be adjustably varied. In the apparatus 12, the adjustable loading is associated with the embossing roller 22 and involves the bearings 25 and 26 thereof. For identification, the adjustment or loading devices are respectively denoted with the numerals 31 and 32, and they are substantially similar both in terms of structure and function and are respectively associated with the frame plates 14 and 15 although the device 31 is along the inner wall of the frame plate 14 whereas the device 32 is disposed along the outer wall of the frame plate 15.

Considering the device 31, it includes an elongated bolt 33 having a threaded shank extending through an internally threaded bore or opening provided in a bracket 34 fixedly secured to the plate 14 by a plurality of cap screws 35. A lock nut 36 enables the bolt 33 to be constrained in any position of adjustment thereof relative to the bracket 34 by being tightened thereagainst. Adjacent its lower end, the shank of the bolt 33 is unthreaded and freely or loosely extends through an opening in an inwardly projecting ledge 37 secured to a pair of spaced apart clamping bars 38 and 39 extending along the inner face of the frame member 14 in substantially contiguous relation therewith and along opposite sides of the axle 29. The shank of the bolt 33 has washers or collars 40 and 41 pinned thereto along opposite sides of the ledge 37 so as to cause the same to be displaced with the bolt relative to the bracket 34 and frame plate 14 while permitting the bolt to be rotated with respect to the ledge.

The spaced apart bars 38 and 39 are each provided with threaded apertures engaged by cap screws 42 that are associated with the bearing 25 and secure the same to the frame plate 14. The cap screws 42 respectively extend through elongated openings 43 in the frame plate 14 that enables the bearing 25 to be displaced with the bolt 33 along the axis thereof whenever the cap screws 42 are loosened. It will also be apparent that the frame plate has a relatively large elongated opening 44 therein through which the roller shaft 29 passes and which opening enables the shaft and its associated embossing roller 22 to be adjustably displaced with the bolt 33. The dimensional limits of the elongated openings 43 and 44 together with the length of the adjustment bolt 33 and spacing between the bracket 34 and bar 37 define the maximum permissible displacements for the roller 22 and bearing structure 25, and any position of adjustment into which the roller is placed is fixedly maintained by tightening the cap screws 42 which clamp the bearing 25 and bars 38 and 39 to the frame plate 14 and by tightening the lock nut 36 to constrain the bolt 33 against rotation. As previously noted, the adjustment device 32 is substantially the same as the device 31 described in detail, and the primed form of the same numerals are used to identify respectively corresponding elements thereof.

The support embossing rollers 20 through 22 are hard or rigid members having substantially unyielding surfaces and, in the usual instance, are formed from steel. These rollers are substantially cylindrical and, in the form shown, have essentially the same diameters. They are also equally spaced, as is shown most clearly in FIG. 5, and have embossing configurations along the web-engaging surfaces thereof which, it will be apparent, are juxtaposed with the surface of the platen roller 23 for cooperation therewith in working the web 24. In this reference, the rollers 20 through 22 are each provided with an embossing configuration that contributes to and forms a part of the composite embossing pattern imparted to the web 24 as it moves through the apparatus 12. More particularly, at least certain of the embossing rollers have linear embossing elements, thereby simplifying construction of the rollers and also contributing to an embossed web of improved quality, as subsequently explained. The rollers 20 and 21 (see FIGS. 3 and 6) have raised embossing ribs on the cylindrical surface thereof which are angularly disposed and have dispositions of the order of 45° in the particular form shown. Thus, the embossing ribs on the roller 20 extend angularly in one direction and impart to the web 24 a plurality of linear or unidirectional depressions that are substantially parallel and oriented at approximately 45° relative to the longitudinal axis of the web so that each depression lies in the $-x$, $+y$ and $+x$, $-y$ quadrants of the usual Cartesian coordinate system when such depression extends through the origin thereof. Similarly, the ribs on the roller 21 extend angularly in another direction and impart to the web 24 a plurality of linear or unidirectional depressions that are substantially parallel and oriented at approximately 45° relative to the longitudinal axis of the web so that each depression lies in the $+x$, $+y$ and $-x$, $-y$ quadrants of such coordinate system when such depression extends through the origin thereof.

Figure 6:
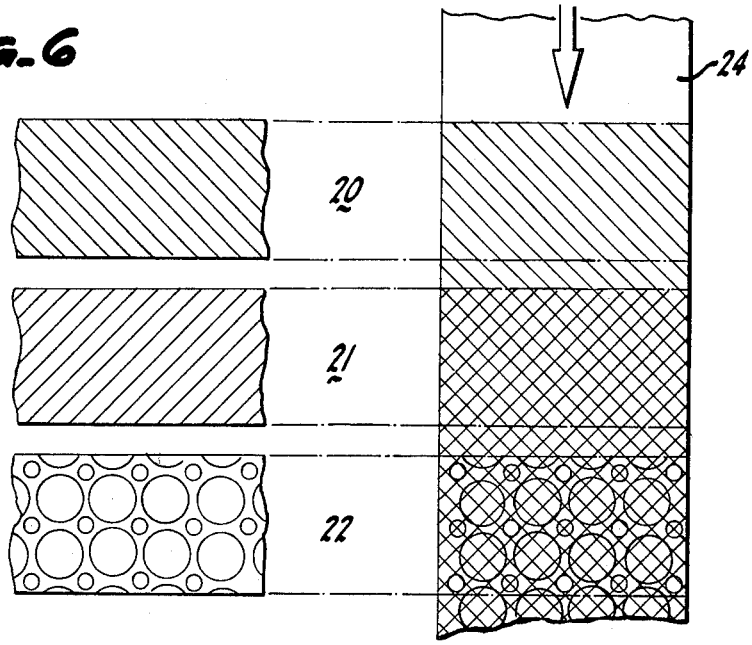
FIG. 6 is a diagrammatic view illustrating the succession of embossing operations imparted to a web processed by the apparatus.

The two embossing configurations provided by the rollers 20 and 21 when superimposed one upon another on the web 24, as shown in FIG. 6, define a plurality of parallelograms. The embossing configurations of the roller 22 may take any form generally selected to cooperate with the embossing configurations of the rollers 20 and 21 to provide an aesthetic appearance. The roller 22 is sometimes referred to as a spot embosser which is generally taken to mean an embossing roller that supplies a localized or design configuration to a web engaged thereby. Rollers 20 and 21, on the other hand, may be referred to as background embossers since the composite pattern embossed thereby forms a background for the spot embossments imparted by roller 22. In any case, the embossing configuration of the roller 22 is superimposed on the configurations of the rollers 20 and 21 to provide the web 24 with the composite pattern shown at the lower right-hand corner portion of FIG. 6.

Each of the embossing rollers 20 through 22 is rotatably driven by means provided for this purpose that may take variant forms including an electric motor or other prime mover (not shown) specifically included in the apparatus 12 or by an interconnection of the prime mover forming a part of the machinery with which the apparatus is associated. The latter arrangement constitutes the drive means in the form of the invention shown in the drawings in which power is derived from a take-off shaft 45 (FIG. 2) extending outwardly through the aforementioned frame member 10 and journalled for rotation with respect thereto in bearing structure 46 secured to the frame member 10 in spaced relation therewith via a mounting bracket 47. The shaft 45 delivers input torque to a variable speed drive assembly 48 of completely conventional construction which rotatably drives an output sheave 49 having an endless drive belt 50 entrained thereabout. The belt 50 is also entrained about a driven sheave 51 forming the input to a variable speed drive assembly 52 that is also completely conventional and has an output shaft 53 connected with the aforementioned shaft 30 of the embossing roller 21 so as to positively drive the same. The drive assemblies 48 and 52 are respectively equipped with reaction pins 54 and 54' connecting the outer casings to the frame components 10 and 14, respectively, to constrain such casing components against rotation.

The shafts or axles 30 and 29 of the embossing rollers 21 and 22 have sheaves 55 and 56 keyed or otherwise secured thereto so as to prevent relative rotation therebetween; and, analogously, the embossing roller 20 is equipped with an axle or shaft 57 having a sheave 58 keyed thereon. An endless belt 59 is entrained about all of the sheaves 55, 56 and 58 so that all of the embossing rollers are driven concurrently in the same angular directions. The drive belts 50 and 59 may be entirely conventional, and are advantageously tooth-equipped belts engageable with similarly toothed sheaves so that slippage is obviated. A take-up roller 60 may be arranged with the belt 59 so as to impart the desired tension thereto. Ordinarily, a brake system is included in web-processing apparatus to prevent momentum over-runs and otherwise to maintain the tension on the web relatively uniform at all times. A conventional brake mechanism 61 is associated with the shaft 57 of the embossing roller 20 for this purpose, and since it is a standard and well known device no further description thereof will be included.

The platen roller 23, as shown best in FIGS. 3 and 4, includes a pair of axially spaced end wall components 62 and 63, and a generally cylindrical backing wall component 64 extending therebetween and defining therewith a pressurizable chamber 65 adapted to be filled with a pressurized fluid to pressure-reinforce the backing wall component 64. In this respect, the backing wall component is inwardly depressible against the force of the fluid acting outwardly thereagainst within the chamber 65; and in more particular terms, the backing wall component is a relatively thin member that is both flexible and resilient. By way of example, the backing wall component 64 may be fabricated from an elastomeric material such as rubber (either natural or synthetic or rubber compositions) having a hardness related to the particular characteristics of the embossing pattern to be imparted to the web 24 by coaction of the platen roller 23 with the respective embossing rollers 20 through 22. Ordinarily, a hardness in the range of about 30 to 60 durometer has been found satisfactory. The backing wall component is reinforced along the inner surface thereof with any one of a variety of materials such as a flexible fabric material (as shown at 66 in FIG. 4). By way of illustration, a typical backing wall 64 may have an over-all length slightly in excess of 100 inches, an outer diameter of approximately 8 inches and wall thickness of about ¼ of an inch; it may be fabricated on non-marking rubber having reinforcing along the inner surface thereof constituting four layers of rayon fabric disposed on the bias. Certain embodiments of the invention having such specific parameters may have a hardness of from 50 to 60 durometer.

The chamber 65 is essentially hollow throughout its entire length, and the end wall components 62 and 63 are rigid members which, for example, may be formed of steel. The end wall components 62 and 63 are generally in the form of caps respectively having large central openings 67 and 68 therethrough, and inwardly extending annular flanges 69 and 70 having outer surfaces substantially coextensive in diameter with that of the backing wall 64. The backing wall adjacent its ends is inserted into the flanges 69 and 70 which may have a succession of ridges or annular grooves extending thereabout for clamping engagement with such end portions of the backing wall component.

The respectively associated end portions of the backing wall component are clamped against the inner surfaces of the flanges 69 and 70 to form a gas-tight seal therewith by wedge or clamping elements 71 and 72 that are generally frusto-conical and are drawn outwardly to compressively wedge the end portions of the backing wall against the flanges 69 and 70 by a plurality of cap screws 73 and 74 extending through openings provided therefor in the respectively associated end wall components 62 and 63 and into threaded openings aligned therewith in the clamping elements 71 and 72. The clamping force is of sufficient magnitude to deform the end portions of the backing wall component into the channels of the flanges 69 and 70, as shown in FIG. 4, to establish a long path forming a pressure-tight labyrinth-type seal.

The chamber 65 is intended to be filled with a gaseous pressure fluid, usually air, and a filler valve 75 is provided for this purpose in one of the clamping elements —the clamping element 71 in the embodiment of the invention being considered. The filler valve 75 may be a conventional check valve such as the type ordinarily associated with automobile tires, and it has been found that it is only necessary to add compressed air occasionally to the chamber 65. In the usual case, a pressure in the approximate range of 20 to 60 psig is satisfactory. A conventional pressure gauge (not shown) may be associated with one of the end wall components 62 and 63 to provide a visual indication of the contemporary value of the pressure within the chamber.

As is most evident in FIG. 3, the platen roller 23 is floatingly supported or confined by the embossing support rollers 20 through 22 and has no rigidly fixed axis of rotation. Accordingly, it is the cooperative engagement of the embossing rollers 20 through 22 with the juxtaposed surface of the platen roller 23 that defines the axis of rotation of the latter which enables the platen roller to seek a natural axis of rotation. The apparatus 12 does include end stops that constrain the platen roller 23 against unlimited axial displacements that might tend to be enforced thereon by non-symmetrical loadings resulting from variations in web thickness, variations in the positioning of the adjustment devices 31 and 32, and dimensional variations due to manufacturing tolerances, etc. In the form shown, such end stops comprise adjustable abutments 76 and 77 respectively associated with the frame plates 14 and 15.

In more particular terms, and as shown best in FIG. 3, the abutment 76 is in the form of a bolt having a threaded shank extending through a threaded bore or opening in the frame plate 14, and fixed in any position of adjustment by a lock nut 78. The abutment 77 is generally similar, and it includes a bolt having a threaded shank extending through and engaging a threaded boss 79 provided centrally in a closure plate or cover 80, and fixed in any position of adjustment by a lock nut 81. The cover 80 overlies a large central opening 82 in the frame plate 15 which has a diameter slightly greater than the outer diameter of the platen roller 23 so as to permit withdrawal of the latter through the frame plate by removing the cover 80. The cover 80 is removably secured to the frame plate 15 by a plurality of cap screws 83.

The end wall components 62 and 63, and more particularly the clamping elements 71 and 72 associated therewith, are respectively provided with thrust bearings 84 and 85 at the centers thereof that are generally aligned with the abutments 76 and 77 so as to engage the same upon any axial displacements of the platen roller. The thrust bearings 84 and 85 take the form of inserts comprised of a relatively low-friction yet wear-resistant material compressed into ball bearings 86 and 87 in the outer surfaces of the clamping elements 71 and 72. By way of example, the thrust bearings 84 and 85 may be nylon elements having arcuate outer surfaces facing the respectively aligned abutments 76 and 77 for engagement therewith. If desired, the ball bearings could be dispensed with and the nylon thrust bearings merely press fit into elements 71 and 72. As shown in FIG. 3, the platen roller 23 is somewhat greater in length than the embossing rollers 20 through 22, thereby enabling some axial displacements of the platen roller to be permissible. Accordingly, when the platen roller is initially centered, the abutments 76 and 77 may be spaced slightly from the respectively facing bearings 84 and 85, as shown in FIG. 4.

The function of the apparatus 12 is generally apparent from the foregoing description, and assuming the structural assemblage described with the platen roller 23 properly positioned and inflated, a web 24 is threaded through the apparatus so as to pass over the embossing roller 20 and through the nip defined thereby with the platen roller 23, intermediate the platen roller and embossing roller 21, and then between the platen roller and embossing roller 22 extending over the latter so as to be delivered therefrom to the web rewinding apparatus comprising the frame members 10 and 11. The embossing rollers 20 through 22 are each positively driven in synchronism with the rewinding apparatus via the drive train including the variable speed drive mechanisms 48 and 52 which are adjusted to assure the requisite tension along the web 24. As the web passes through the successive nips or stations respectively defined by the rollers 20 through 22, and platen roller 23 each embossing support roller imparts the embossing configuration thereof to the web so that it has the predetermined composite embossing pattern when it leaves the apparatus. If desired, the web path may be varied by the operator so that it does not pass through the nips formed by all three support rollers with the platen roller. For example, if only spot embossing and not background embossing is desired, the operator may thread the apparatus so that the web passes only through the nip formed between roller 22 and the platen roller. Of course, the web could just as easily be directed through two nips as between one or three.

As is most evident in FIG. 5, the web 24 is married to the platen roller 23 and backing wall component 64 thereof as the web passes through each station and intermediate the same. Thus, when as illustrated the web 24 passes through all three nips or stations the web 24 is supported in intimate engagement with the backing wall 64 of the platen roller adjacent the entrance to the first operating station, and remains in supported engagement therewith until it leaves the final operating station after the last embossing operation has been performed thereon. Such continuity of support for the web 24 also contributes to the ability of the present system to handle relatively weak, readily fractured or torn webs and enables them to be worked or embossed whereas such webs are not readily processed in conventional apparatus because in conventional apparatus not only are undue stresses imparted to the web at the embossing nip due to deformation of conventional rubber coated platen rollers as has been previously described, but, also, the requirement imposed by conventional multi-station embossing systems that the web be withdrawn from the platen roller intermediate the embossing stations imposes a severe limitation on the strength of webs that can be processed.

In this reference, and as is particularly shown in FIG. 5, the localized compressive force applied by each roller 20 through 22 to the backing wall component 64 of the platen roller displaces the backing wall component inwardly against the outwardly acting pressure force, and any such inward displacement is readily accommodated with substantially no change in magnitude of the pressure within the chamber 65 because of the very large volume thereof relative to the very small change in volume occasioned by localized inward displacement of the backing wall component. As a result, there is no outward displacement or bulging of a mass of resilient material to necessarily enlarge the circumference of the platen roller, as is found in conventional platen rollers having a rigid steel core enclosed within resilient cover, and which phenomenon results in a velocity differential of an undesireable magnitude as between the platen roller, embossing roller and web that stretches or elongates the latter longitudinally in an uncontrolled manner and to an excessive degree, and tends to fracture the same. The free floating characteristics of the platen roller 23 additionally contribute to the capability of the apparatus to accommodate relatively weak webs because it automatically normalizes and equalizes compressive forces about the platen roller and along any web supported thereby. It will thus be seen that a cooperative relationship exists between the gas filled platen roller and the support rollers which functions to prevent excessive forces from being applied to a web in at least three respects. First, the arrangement does away with platen roller "bulge" Second, web tension between multi-station embossers is obviated. Third, compressive forces are automatically equalized because of the "floating" character of the platen roller. The results is that the system can be used to emboss even low strength webs such as webs of low basis weight tissue paper.

The multiple workings of the web 24 at the successive stations along the arcuate path of travel defined by the platen roller 23 soften the web and increase the apparent bulk thereof so that it has a more satisfying feel and texture. It has been found that the disclosed system loosens the surface fibers of a paper web passing therethrough to provide a "napped" surface of debonded fibers. Apparently, this result is due to a scuffing action that occurs as the web passes through a nip formed by an embossing roller and inflated platen roller. A "napped" surface adds to the soft feel and absorbency of the web and these characteristics are particularly desirable in consumer paper products. While the napping occurs on both sides of the web, it is particularly pronounced on the side contacting the embossing roller, even when a relatively hard elastomeric material is used in the construction of the platen roller. This surface softening of fibers should be compared with prior art arrangements employing relatively hard platen roller covers of rubber or the like which tend to smooth out or flatten the surface of a paper web, rather than nap it, thus lowering the apparent bulk and absorbency as well as imparting a smooth surface "feel" deemed undesirable in consumer paper products such as facial tissue, toilet tissue and paper towels.

The present arrangement may be utilized with a wide variety of web materials. Where the web is paper, for example, the system may be employed to emboss paper webs having different basis weights, incorporating different pumps, etc. If necessary the constituent elements of the system may be readily and inexpensively modified or even replaced to accommodate different web materials and maximize performance of the system with respect thereto. For example, the platen roller may be readily pressurized or depressurized, platen roller backing wall components may be readily substituted, embossing rollers may be readily interchanged, added or deleted, etc. In summary, the system has a flexibility not remotely suggested in the prior art.

Further, subdividing the composite embossing pattern into elemental components not only simplifies the construction of each embossing roller, but it also facilitates changing the pattern should this be desired by replacing one or more embossing rollers. Because of the yieldability of the platen roller it is not necessary that embossing rollers be engraved as is often the case in prior art arrangements to provide the requisite degree of embossing strength to work against rubber coated steel rollers or the like. In fact, removable sheet metal sleeves stamped with an embossing pattern have been satisfactorily used in the system. Subdividing the composite embossing pattern also tends to eliminate the one-sided effect and resultant harshness of the web that occurs when the entire pattern is embossed in a single operation. Obviating this result appears to be attributable to the fact that the web is effectively embossed about the center plane thereof in contradistinction to the one-sided condition that results when a closed pattern is embossed entirely at one time. Also, the reworking of the web that occurs at each successive station tends to attenuate or soften the web after each prior embossing operation.

The platen roller 23 is rotatably driven because of its engagement with the rollers 20 through 22, and because the roller is hollow, it has a relatively low inertia and does not build up excessive heat which is a characteristic of steel-core, resilient-cover platen rollers that are apparently heated because of the mechanical hysteresis of the steel core resulting from working forces imparted thereto. Further, the heavy bearing structures required for the embossing rollers of a conventional embossing apparatus are obviated herein because the loading force required for any one roller is reduced in proportion to the number of embossing stations. Further in this same sense, the embossing rollers can be of lesser strength and therefore of smaller diameter as a result of the reduced loading forces thereon. Also, as stated above, stamped embossment sleeves rather than engraved rollers may be used thus greatly reducing cost and adding to overall system flexibility. Changes in loading can be accomplished readily by varying the pressure within the chamber 65, increasing the pressure to increase the loading force, and vice versa. Any particular loading force, and change therein, results in an essentially uniform compressive force along the entire length of the platen roller 23 since it is floatingly supported in contrast to conventional rigid platen rolls which have a fixed axis of rotation and tend to bow intermediate the heavy bearing supports at the ends thereof. Moreover, the backing component 64 of the platen roller readily conforms to any bowing of the respective embossing rollers. Because of this and the fact that the platen roller weight is not great as compared to conventional platen rollers, the support embossing rollers may be of a relatively small diameter. The floating platen roller 23 is supported at three angularly spaced locations in the embodiment shown in FIG.

5, but it may be either supported or associated with other numbers of rollers as, for example, the greater number shown in FIG. 7. All of the rollers in the embodiment of FIG. 7 may be used concurrently, in which case the web is simply worked to a greater extent, thereby enhancing the softness and bulk thereof. However, the rollers may be used selectively or alternatively which adds versatility to the apparatus. In the modified embodiment of FIG. 7, the platen roller is denoted with the numeral 23*a*, and it may be the same both structurally and functionally as the platen roller 23 heretofore described. It is similarly associated with a plurality of angularly spaced embossing rollers 20*a*, 21*a*, 22*a* which respectively correspond to the previously described rollers 20 through 22.

The modified apparatus 12*a* of FIG. 7 includes additional embossing rollers 88*a* and 89*a* which are respectively disposed adjacent the aforementioned rollers. As illustrated, the web 24*a* enters the apparatus about the roller 88*a* and leaves the apparatus from the roller 22*a*, and is maintained in intimate supported engagement with the platen roller 23*a* throughout the entire length extending between and through all of the operating stations. The web may be directed through a lesser number of nips or stations if desired. All of the embossing rollers may be positively driven by means of an endless belt 59*a* entrained thereabout, in the manner previously described, and by means of a driving torque delivered to the roller 89*a* via an input belt 50*a*. One or more of the five embossing rollers shown may be equipped with adjustment devices 31 and 32 as previously described, so that any such roller so equipped therewith can be displaced from the platen roller 23*a* and will not then coact therewith. The idler sheave 60*a* associated with the drive belt 59*a* can be arranged to accommodate any such displacement of one or more of the embossing rollers. Otherwise, the modified apparatus 12*a* functions in the same manner as the apparatus 12 heretofore described.

As previously noted, the apparatus is suitable for use with various web materials including paper webs of many types as, for example, those used for toilet tissue, toweling, facial tissue, and Kraft paper of the type used for paper grocery bags. The web may also be polyethylene or other plastic films, webs made of synthetic pulp, laminates, and substantially all other materials where embossing or other working thereof is advantageous.

A form of the apparatus embodying the present invention that has been found particularly suitable for use in the embossment of paper tissue grades is illustrated in FIGS. 8 and 9. In this particular embodiment a platen roller 23*b* which may be the same both structurally and functionally as the platen roller 23 heretofore described, is floatingly confined by four support rollers 20*b*, 21*b*, 110 and 22*b*. A paper tissue web 24*b* follows the path indicated, that is, successively between the nips formed between rollers 20*b*, *21b*, *110 and 22b*, respectively, and the platen roller. Support rollers 20*b* and 21*b* cooperate with the platen roller 23*b* to provide web 24*b* with background embossing. The rollers 20*b* and 21*b* may have the same overall configuration as previously described rollers 20 and 21 and as may best be seen with reference to FIG. 9, have raised embossing ribs on the cylindrical surface thereof which are angularly disposed and have dispositions of the order of 45° in the particular form shown. Thus, the embossing ribs of the roller 20*b* extend angularly in one direction and impart to the web 24*b* a plurality of linear or unidirectional depressions but are substantially parallel and oriented at approximately 45° relative to the longitudinal axis of the web so that each depression lies in the $-x$, $+y$ and $+x$, $-y$ quadrants of the usual Cartesian coordinate system when such depression extends through the origin thereof. Similarly, the webs on the roller 21*b* extend angularly in another direction and impart to the web 24*b* a plurality of linear or unidirectional depressions that are substantially parallel and oriented at approximately 45° relative to the longitudinal axis of the web so that each depression lies in the $+x$, $+y$ and $-x$, $-y$ quadrants of such coordinate system when such depression extends through the origin thereof. The two embossing configurations provided by the rollers 20*b* and 21*b* when superimposed one upon another on the web 24*b*, as shown in FIG. 9, define a plurality of parallelograms.

After the embossing patterns are impressed on web 24*b* by background embossing rollers 20*b* and 21*b* to work and soften the web, the web 24*b* passes through a nip formed by platen roller 23*b* and support roller 110. Support roller 110 has a completely smooth surface which cooperates with the surface of platen roller 23*b* in the vicinity of the nip formed therebetween to erase or wipe out the appearance of the parallelogram background embossments on the tissue web. The softness imparted by the background embossers remains however. From the nip formed between platen roller 23*b* and smooth support roller 110, tissue web 24*b* then proceeds into the nip formed between spot embossing roller 22*b* and platen roller 23*b*. As with previously described roller 22, the embossing configuration of the roller 22*b* may take any form desired to provide an overall aesthetic appearance.

Rollers 20*b*, 21*b* and 110 may be positively driven by means of an endless belt 59*b* entrained about drive pulleys affixed to the ends of these rollers in the manner previously described with respect to the other embodiments of this invention. Endless belt 59*b* is in turn driven by a drive belt 50*b* through an input idler roll 112 with which both belts are operatively associated.

It has been found that the arrangement shown in FIGS. 8 and 9 provides a tissue product having exceptional body softness and good surface feel, attributes that are desired in personal tissue products such as toilet tissue and facial tissue, when the smoothing roller 110 is driven at a somewhat faster speed than are background embossing rollers 20*b* and 21*b*. This can be readily accomplished by employing a drive pulley in conjunction with smoothing roller 110 which is somewhat smaller than the driving pulleys associated with the other support rollers in the arrangement. Of course, timing gears or other suitable driving arrangements may be utilized if desired. The smoothing roller 110, by rotating at a faster speed than background embossing rollers 20*b* and 21*b*, not only reduces sharp creases that may be produced in the web by background embossing rollers 20*b* and 21*b* but also additionally scuffs the sheet surface so that additional "napping" takes place. It has been found that a speed differential of approximately 6 to 8% is generally suitable although the speed differential may of course be varied in accordance with operational requirements. While the background embossing rollers have worked and softened the web any deleterious effects they may have imparted to the thus softened web by virtue of their imparting a sharp surface feel thereto will have been erased by the smoothing roller 110 while the smoothing roller will additionally nap the sheet due to its differential speed. Spot embossing roller 22*b* is preferably never directly driven but rather attains its rotational speed through its frictional engagement with platen roller 23*b* and web 24*b*.

Any of the forms of the apparatus constructed in accordance with the teachings of the present invention may include static-charge eliminators which are usually located adjacent the discharge side thereof; and may also include suitable web guides adjacent the last nip through which the web passes to direct the web away from the system. Neither of these structures are shown since they are standard components have no bearing on the present invention. The wedge-type grip defined between the end wall components 62 and 63 and respectively associated clamping elements 71 and 72 of the platen roller is quite tight and requires compression of the clamped end portions of the backing wall component to a substantial extent. Accordingly, it may in many instances be advantageous to provide a special tool for use in displacing the clamping elements relative to their associated end components to an extent necessary for initial engagement of the cap screws 73 and 74. Such tool is not shown since the assembly steps are not pertinent to the present invention.

The backing wall component 64 is in the nature of an endless belt although substantially shorter than usual endless belt structures. However, the precise length of the backing wall component is not a critical feature of the invention. Also, the adjustment assemblies 31 and 32 may take variant forms including one in which any particular adjustment is maintained as the loading on the roller is released to displace the same relative to the frame components 14 and 15. By way of example, the lock nuts 36 and 36′ can be made clamp collars confined in any position of adjustment along the bolts 33 and 33′ so that a particular condition of adjustment can be reattained simply by tightening the bolts until such members 36 and 36′ seat against the elements 34 and 34′, as shown in FIG. 3.

While in the foregoing specification embodiments of the invention both in terms of apparatus and method have been set forth in considerable detail for purposes of making a complete disclosure thereof, it will be apparent to those skilled in the art that numerous changes may be made in such details without departing from the spirit and principles of the invention.

I claim:

1. Apparatus for embossing a paper web or the like, comprising:

frame structure;

a plurality of angularly spaced apart support rollers supported for rotatable movement with respect to said frame structure about a common center with their axes of rotation substantially parallel, at least two of said support rollers comprising embossing rollers each provided with an embossing surface defining an embossing configuration forming a part of a composite embossing pattern and engageable with such web to emboss the same therewith;

a platen roller floatingly confined by said support rollers with no rigidly fixed axis of rotation for rotatable movement with respect to said frame structure, said platen roller having both a cylindrical, essentially non-metallic, expansible and resilient backing wall component providing a backing surface disposed in facing juxtaposition with said embossing surfaces, and, in cooperation with the latter, being engageable with such web to emboss the same with a composite pattern comprised of each of said embossing configurations, and a gaseously-charged pressurizable chamber encompassed by said backing wall component to distend said backing wall component and urge said backing surface into intimate engagement with said embossing surfaces to form nips therewith, said backing wall component being depressible inwardly by said embossing rollers against the force exerted by the pressurized gas without significant outward bulging occurring in the backing wall component adjacent to said nips due to compression of said gaseous fluid in response to said depression, so that essentially no tensile force is imparted to the web passing through said nips as a consequence of velocity differences between the embossing and backing surfaces thereof; and means for rotatably driving said rollers.

2. The apparatus of claim 1 in which each of said embossing rollers is a substantially rigid unyielding component, at least one embossing roller having open generally linear elements of the composite embossing pattern provided along its web-engaging surface to obviate perimetric area clamping of such web when embossed by said linear elements.

3. The apparatus of claim 1 in which said platen roller further includes end wall components cooperative with said cylindrical backing wall component and defining said pressurizable chamber therewith.

4. The apparatus of claim 3 in which said platen roller is equipped with valve means communicating with said chamber to enable the gaseous pressure therewithin to be regulatively adjusted.

5. The apparatus of claim 1 in which all of said angularly spaced support rollers comprise embossing rollers each having a surface thereof disposed in facing juxtaposition with the backing surface of said platen roller and having an embossing configuration along its web-engaging surface engageable with such web to emboss the same as aforesaid, whereby the composite pattern embossed along such web includes configurations contributed thereto by each of said embossing rollers, and in which each of said embossing rollers is a substantially rigid unyielding component, at least one embossing roller having open generally linear elements of the composite embossing pattern provided along its web-engaging surface.

6. The apparatus of claim 1 in which the aforesaid driving means directly rotatably drives each of said embossing rollers.

7. The apparatus of claim 1 wherein at least one of said support rollers has a smooth non-embossing surface.

8. A method of progressively embossing a paper web or the like at a plurality of successive stations including embossing stations spaced apart along a predetermined arcuate path comprising the steps of:

advancing such web along said arcuate path and through successive stations;

maintaining the web in continuous, intimate and uniform engagement along one side thereof with an essentially non-metallic, cylindrical flexible support component defining the arcuate configuration of said path throughout the entire length of web extending at any time essentially through and between said successive stations;

applying an embossing force at a plurality of said embossing stations by impressing the embossing surfaces of embossing rollers to the other side of said web which thereby exhibits a compressive force against said substantially cylindrical support component to deform the same in the vicinity of said plurality of embossing stations; and controlling the resultant deformation of said support component so that substantial deformation of said support component occurs only in the direction of said compressive force and no appreciable localized tensile forces are applied to such web due to such deformation tending to rupture the web due to the elongation thereof, said step of controlling the deformation of said support component comprising exerting a gaseous pressure force uniformly against the side thereof opposite said web enabling the support component to be displaced bodily thereagainst in response to the compressive force exerted thereagainst at each of said embossing stations, thereby obviating outward surface enlargement of said support along such web otherwise attributable to compressive deformation.

9. The method of claim 8 wherein said support component is a cylindrical platen roller having a substantially smooth outer surface and said stations are angularly spaced therealong; in which the step of applying an embossing force at said embossing stations includes the provision at each such embossing station of an embossing roller having an embossing surface forming a nip with said platen roller; and in which such web is continuously advanced along the arcuate path of travel defined by said support component through the nips formed at said successive stations.

10. Apparatus for embossing web material comprising:

frame structure;

a plurality of cylindrical support rollers mounted for rotation with respect to said frame structure at angularly spaced locations about a common center with their axes of rotation oriented in substantially parallel relation, at least one of said support rollers being an embossing roller having an embossing surface;

an inflated platen roller floating confined by said support rollers with the axis of rotation of said platen roller being non-fixed and substantially parallel to the axes of rotation of said support rollers, said platen roller comprising an essentially non-metallic, cylindrically-shaped, resilient backing wall component having a substantially smooth outer backing surface and a hollow chamber containing a gas pressurized above atmospheric pressure in communication with said cylindrically-shaped, resilient backing wall component along the side thereof opposite said smooth outer backing surface and exerting an outward force on said backing wall component of sufficient magnitude to cause the backing wall component to assume a stretched condition having a greater diameter than when the platen roller is not inflated and said backing wall component is in a non-stretched condition, said backing wall component when in said stretched condition being in intimate engagement with the outer peripheral surfaces of at least three of said cylindrical support rollers to provide a plurality of nips between the support rollers and the platen roller spaced about the periphery of said backing wall component with the backing wall component flexing to accommodate any deformation occurring in said support rollers, the engagement between said at least one embossing surface and said backing surface displacing said backing wall component inwardly against said outwardly acting pressure force to minimize deformation of said backing wall component at the outer edges of the nip formed between said at least one embossing surface and the backing surface whereby substantially no velocity differential is created between the backing surface and said at least one embossing surface during rotation of said rollers and essentially no non-embossing tensile force is imparted to a web passing therebetween; and means for rotatably driving said rollers.

11. The apparatus of claim 10 wherein at least one of said support rollers has a substantially smooth peripheral surface.

12. The apparatus of claim 11 wherein a support roller having a substantially smooth peripheral surface occupies a predetermined position relative to said other support rollers whereby the web is adapted to pass through the nip formed between the platen roller and the support roller having a substantially smooth peripheral surface after passing through the nip formed between the platen roller and an embossing roller.

13. The apparatus of claim 11 wherein said support rollers comprise at least one background embossing roller, a roller having a substantially smooth peripheral surface and a spot embossing roller adapted to be contacted in seriatim by the web.

14. The apparatus of claim 12 wherein said driving means drives said support roller having a substantially smooth peripheral surface at a higher speed than it drives said embossing roller wherein said speed differential is in the range of about 6–8%.

15. The apparatus of claim 10 including means for maintaining said gas pressure in said platen roller hollow chamber in the range of about 20 to about 60 psig.

16. The apparatus of claim 10 wherein said resilient backing wall component has a hardness in the range of about 30 to about 60 durometer as measured at said smooth outer backing surface.

17. A method of embossing web material comprising the steps of:

advancing the web material along a predetermined arcuate path through a plurality of successive work stations;

maintaining the web in substantially continuous, intimate and uniform engagement along one side thereof with an essentially non-metallic, cylindrically-shaped resilient support component throughout the entire length of web extending at any time essentially through and between said successive stations;

applying an embossing force at at least one of said stations to the other side of said web which thereby exhibits a compressive force against said support component to deform the same in the vicinity of the associated station; and controlling the resultant deformation of said support component so that substantial deformation of said support component occurs only in the direction of said compressive force and no appreciable localized tensile forces are applied to such web due to such deformation tending to rupture the same, said step of controlling the deformation including exerting a gaseous pressure greater in magnitude than atmospheric pressure against said resilient support component in opposition to said compressive force.

18. The method of claim 17 additionally comprising the step of napping the web by applying a substantially uniform tangential force to the surface of the web on said other side thereof at at least one of said stations.

19. A method of embossing web material comprising the steps of:

disposing a plurality of work stations along a predetermined arcuate path;

moving an essentially non-metallic resilient support member along said predetermined path;

continuously exerting a gaseous pressure greater in magnitude than atmospheric pressure against said resilient support member along a first side thereof to stretch said resilient support member and continuously urge said stretched resilient support member against compressive forces exerted against the resilient support member at said plurality of work stations along a second side thereof in opposition to said first side, at least one of said compressive forces comprising an embosssing force;

deforming said stretched resilient support member at said plurality of work stations through the application of said compressive forces;

disposing web material in engagement with said resilient support member on said second side thereof;

passing said web material through at least one work station whereat the compressive embossing force is applied to said web material at the side thereof not in engagement with said resilient support component so that said web material is embossed due to the cooperation of said compressive embossing force and the opposing force developed by said gaseous pressurized resilient support member; and controlling the resultant deformation of said resilient support member so that substantial deformation of said support member occurs only in the direction of said compressive force and no appreciable localized non-embossing tensile forces tending to stretch said web material are applied to said web material due to such deformation.

20. The method of claim 19 wherein said resilient member has a hardness in the range of about 30 to about 60 durometer as measured at said second side thereof.

21. The method of claim 19 wherein said gaseous pressure is in the range of about 20 to about 60 psig.

* * * * *